United States Patent [19]

Barth et al.

[11] 4,185,939

[45] Jan. 29, 1980

[54] GROUND COVERING SLAB

[76] Inventors: Günter Barth, Am Schwalbenloch 7, D-7500 Karlsruhe 41; Fritz von Langsdorff, Blumenstrasse 12, D-7551 Förch, both of Fed. Rep. of Germany

[21] Appl. No.: 923,581

[22] Filed: Jul. 11, 1978

[30] Foreign Application Priority Data

Jul. 18, 1977 [DE] Fed. Rep. of Germany ..... 2732452

[51] Int. Cl.[2] ..... E01C 5/00

[52] U.S. Cl. ..... 404/38; 52/590; D25/80

[58] Field of Search ..... 404/38, 41, 42, 39, 404/37; 52/311, 590, 98, 99; D25/80

[56] References Cited

U.S. PATENT DOCUMENTS

| | | | |
|---|---|---|---|
| 621,100 | 3/1899 | Knowles | 52/590 X |
| 681,834 | 9/1901 | Porter | 404/38 |
| 719,790 | 2/1903 | Gregory | 404/32 |
| 1,058,674 | 4/1913 | Kertes | 404/38 X |
| 1,474,779 | 11/1923 | Kammer | 52/590 |
| 1,595,686 | 8/1926 | Perry | 404/42 |
| 3,242,832 | 3/1966 | Schnaar | 404/41 X |
| 3,343,468 | 9/1967 | Schraudenbach | 404/38 |
| 3,557,669 | 1/1971 | Fenton | 404/42 |
| 3,891,340 | 6/1975 | Bolli | 404/38 |
| 3,897,164 | 7/1975 | Dodino | 404/41 |

*Primary Examiner*—Nile C. Byers, Jr.
*Attorney, Agent, or Firm*—Spencer & Kaye

[57] ABSTRACT

A ground covering slab is subdivided into neighboring preformed individual stones interconnected along rupture zones of which at least parts extend non-rectilinearly from one edge of the slab to the opposite edge of the slab as seen in plan view and the preformed individual stones are of at least two kinds differing in size distributed throughout the slab.

13 Claims, 3 Drawing Figures

GROUND COVERING SLAB

BACKGROUND OF THE INVENTION

This invention relates to ground covering slabs or covering elements, preferably made of concrete, subdivided into neighboring individual stones interconnected along ruptures or weakening zones.

Covering elements with weakening zones extending through them have the advantage that, firstly areas to be reinforced with them can be covered very economically since with every (preferably mechanized) placing operation a relatively large cover area can be laid, and, secondly fracture courses are preformed so that the covering elements, e.g. when processed with vibrators, or upon thermal stressing or stressing by traffic, may break into individual stones, not at unintended locations but at locations intended for this purpose.

It is an object of the invention to provide an improved ground covering slab.

BRIEF DESCRIPTION OF THE INVENTION

Accordingly the invention provides a ground covering slab sub-divided into neighboring preformed individual stones interconnected along rupture zones of which at least parts extend non-rectilinearly from one edge of the slab to the opposite edge as seen in plan view, the preformed individual stones being of at least two kinds differing in size distributed throughout the slab. Since, in the case of the covering element embodying the invention, at least part of the weakening zones runs non-rectilinearly or in a non-straight line such that at least two types of individual stones of different sizes are preformed, distributed over the entire covering element surface, a stiffening of the covering element results which is important in particular in order to avoid unintended breakage when working with the covering element, e.g. during production, transport and placement.

Preferably, the weakening zones are so arranged that at least in one direction no weakening zones are present which extend a straight line from one edge of the covering element to its opposite edge. Most preferred is that none of the weakening zones extend in a direction which is a straight line through the covering element. Since the stiffening aimed at is particularly important in the middle region of the covering element, preferably care is taken that the weakening zones in that region have a non-straight line course.

The non-straight-line course of the weakening zones in covering elements embodying the invention with preforming of differing individual stone sizes is to be distinguished from non-straight-line weakening zone courses which come about in the case of preformed individual stones of interengaging contour, merely because they have projections and recesses at their periphery with respect to an imaginary datum line, being projections and recesses with which an individual stone can engage two neighboring individual stones. In the case of covering elements embodying the invention, the preformed individual stones need not have any interengaging stone periphery, although that too is additionally possible. With the invention, the extent of the deviation from straight-linearity of the weakening zones may be selected very freely and is not tied to the extent by which, in the case of interengaging stones, the recesses are usually set back with respect to the projections.

Preferably in covering elements embodying the invention, individual stones of the different sizes follow one another in regular alternation. The covering element offers an attractive, living and decorative appearance.

The weakening zones may for example be formed by dummy joints between the preformed individual stones extending from the upper flat side of the covering element for example vertically into the interior of the covering element. These dummy joints may locally occupy the whole height of the covering element so as to form gaps leaving individual connecting bridges standing between the individual stones.

Preferably some sections of the weakening zones or all the weakening zones are formed by connecting elements or bridges between individual stones, which bridges terminate below the upper flat side of the covering element. These bridges may continuously form a weakening zone or be produced as a series of bridges that are mutually spaced. Preferably the bridges terminate sufficiently far below the upper flat side of the covering element that sand introduced into the joints between the individual stones above the bridges completely covers the bridges. In this way, when the covering has been laid, there is no visual indication that it is produced from covering elements with weakening zones, neither before the bridges are ruptured nor thereafter. Rather, the visual impression is that of a finished covering consisting of individually laid single stones of different sizes. This represents a substantial advantage since the customers prefer that the connections between the individual stones should not be visible, particularly the connections in the later described groups of individual stones.

In a further development of the invention, the connections between the individual stones of the covering element are of variously dimensioned thickness. How thick the dimensioning is selected at specific points of the covering element is governed by the local stressing to be expected during transportation and in the laid state. The connections should, for one thing withstand the transportation stresses, and secondly they should determine the fracture course when appropriately stressed for example by traffic loading or through thermal stressing. The varying dimensioning need not be restricted only to the selection of two types of connecting elements; that is, strong connections between the individual stones of the later described groups and weak connections between the groups. For example, connections of different strengths may also be provided between the groups, e.g. particularly strong connections in the middle of the covering element. In particular, steps can be taken to see to it that in the case of progression along a weakening zone on the shortest route from one edge of the covering element to the opposite edge both relatively weak and relatively strong weakening zone sections or bridges are present. This applies in particular to weakening zones in particularly fracture-endangered areas.

Preferably, in each case there is provided only a single bridge between two neighboring individual stones. However, instead of a single bridge between neighboring individual stones, a larger number of bridges may also be provided and/or, at individual locations, particularly where there is little stress, bridges between neighboring individual stones may be omitted altogether.

In a particularly preferred further development of the invention a plurality of stones are joined to form a group by being interconnected by connecting portions that are less weak than the connecting portions that connect them to stones forming part of other groups. In this way a fracture behaviour of the covering elements is achieved which can be regarded as graduated: when subjected to loads starting from a certain order of magnitude, the weakening zone sections between the groups break first and there remain groups of several individual stones, the stones in one group cohering with each other. As the groups are larger in size than the individual stones, the interengagement between neighboring groups is in general better than the interengagement between neighboring individual stones in the state when all weakening zone sections are broken. Upon still greater loading the weakening zone sections between the individual stones of the respective groups, by which the fracture course is determined within the group, then also break. The groups may for example consist of 2, 3, 4 or even more individual stones. Groups are envisaged which preferably consist of pairs of individual stones one of larger size and the other of smaller size. This gives a visually attractive covering element and leads to elongated groups which have desirable properties for the condition of the laid covering after the first fracture step when only the weakening zone sections between the groups are broken.

Preferably the bridges between individual stones within a group are relatively strong, each of them being greater in cross-section (as seen between the upper flat side and the lower flat side of the covering element) than half the area of the side of the stone that confronts its neighbor.

Preferably the chosen shape for individual stones has a contour with corners as seen in plan view; the angles subtended at the center of the individual stones being all smaller than 180°, preferably between 90° and 180°. Such corners of individual stones are less sensitive to accidental fracture. Between the corners, the sides of the individual stones may be formed by plane surfaces, several surfaces at an angle to one another or curved surfaces. In the last-mentioned case, the curved surfaces may so merge into one another that no distinct corners form at all.

A particularly preferred covering element embodying the invention has a regular alternating sequence of square and octagonal individual stones. This embodiment demonstrates particularly clearly that the effects intended by the invention can be achieved even with quite simple contours of individual stones.

It has been found favorable for many purposes to recess the individual stones of smaller size slightly with respect to the plane containing the upper flat sides of the larger individual stones; in such cases, by upper flat side of the covering element there is understood the surface formed by the upper sides of the individual stones which are not recessed. Recessing of the individual stones of smaller size is advantageous in that it helps avoid damage to the individual stones of smaller size during vibration of the covering element into the substrate, in general a sand bed.

When elongated individual stone groups are formed by intended fracture zone sections of higher strength, these elongated individual stone groups may be arranged, at least in the interior of the covering element, preferably in herring-bone pattern. This provides just in the particularly fracture-endangered interior of the covering element, a course of the weakening zones between the groups which deviates particularly greatly from the straight-line course. The individual stone groups can also be arranged in other composite patterns, e.g. longitudinal bond, i.e. an arrangement in rows in which the groups are longitudinally offset from row to row, or parquet bond in which in each case two groups with their longitudinal sides adjoining are abutted at their ends by another two such groups oriented transversely by being rotated by 90° with respect to the first mentioned group.

When the individual stones have corners as seen in plan view, preferably the corners are devoid of connections in order to avoid unwanted fractures or damage at the corners.

SHORT DESCRIPTION OF THE DRAWINGS

The invention is more fully described below with reference to the accompanying drawings which show diagrammatically by way of example an embodiment thereof; in the drawings.

DETAILED DESCRIPTION OF PREFERRED EMBODIMENT

Figure 1:
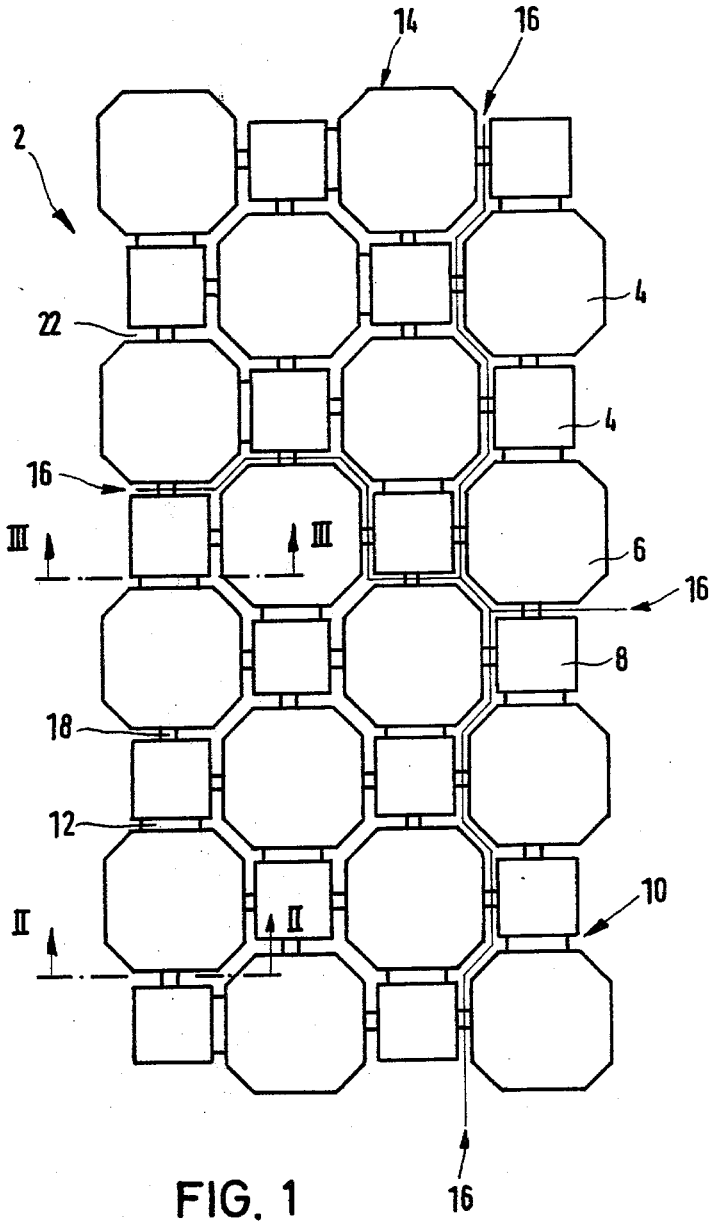
FIG. 1 is a plan view of a covering element.

The covering element 2 shown in FIG. 1 is built up from thirty-two individual stones 4, namely sixteen octagonal individual stones 6 and sixteen square individual stones 8. The octagonal individual stones 6 can be thought of as having originated from square individual stones in which the four 45° corners are so cut off that, of the original square, sides remain standing of a length which corresponds to the side length of the square individual stones 8. Accordingly, the square individual stones 8 join favorably to the "remaining" sides of the octagonal individual stones 6.

Figure 3:
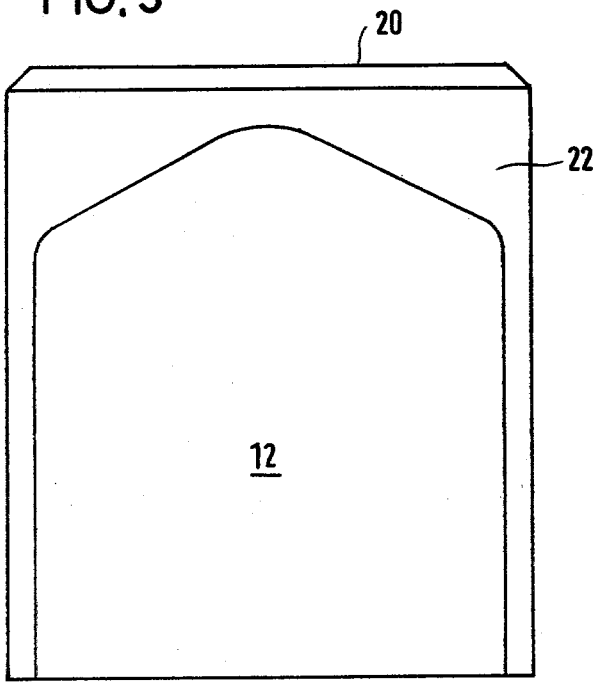
FIG. 3 is a bridge cross-section as seen along III—III in FIG. 1 of a bridge between the individual stones of the groups on a larger scale than FIG. 2.

Each octagonal individual stone 6 is joined together with a neighboring square individual stone 8 to form a group 10 in that a bridge 12 representing a connecting portion or weakening zone section is provided between them whose cross-section occupies more than half of the immediately opposite side surface areas of the individual stones 6 and 8 of this pair (see FIG. 3). It is also possible to join together more than two individual stones 4 to form a group 10, e.g. one octagonal individual stone 6 with two, three or four square individual stones 8; one square individual stone 8 with two, three or four octagonal individual stones 6. The covering element 2 consists of four longitudinal rows of individual stones 4 and eight transverse rows of individual stones 4. The rows may be greater or lesser in number, even numbers being preferred. The left-hand longitudinal row in FIG. 1 begins in FIG. 1 at the top with an octagonal individual stone 6 and terminates below with a square individual stone 8. The longitudinal row following thereon to the right begins at the top with a square individual stone 8 and ends below with an octagonal individual stone 6. The third longitudinal row following thereon to the right is in this respect built up like the first longitudinal row whereas the fourth longitudinal row on the extreme right in FIG. 1 is in this respect built up like the second longitudinal row. When, in FIG. 1, one considers the extreme left-hand longitudinal row from the top downwards, the sequence is one bridge 12 of large cross-section, two bridges 18 of small cross-section, one bridge 12 of large cross-section, one bridge of small cross-section, one bridge of large cross-section and one bridge of small cross-section. In the second longitudinal row the sequence is as follows: three bridges of small cross-section, one bridge of large cross-section, one bridge of small cross-section, one bridge of large cross-section, one bridge of small cross-section. In the third row the sequence is as follows: two weak bridges, one strong bridge, one weak bridge, one strong bridge, one weak bridge, one strong bridge. In the fourth row the sequence is as follows: one strong bridge, one weak bridge, one strong bridge, one weak bridge, one strong bridge, one weak bridge, one strong bridge. When the transverse rows of the individual stones 4 are now considered, the following sequences result. In the first uppermost transverse row from left to right: one weak bridge, one strong bridge, one weak bridge. Likewise, in the second transverse row: one weak bridge, one strong bridge, one weak bridge. In the third transverse row: one strong bridge, one weak bridge, one weak bridge. Likewise in the fourth, fifth, sixth, and seventh transverse row: in each case, three weak bridges. In the bottom transverse row, likewise: one strong bridge, two weak bridges.

Octagonal individual stones 6 and square individual stones 8 follow one another in regular alternation both in longitudinal direction and in transverse direction of the covering element 2. Each square individual stone 8 is surrounded—except at the edge of the covering element 2—by four octagonal individual stones 6, while each octagonal individual stone 6—except at the edge of the covering element 2—is surrounded by four square individual stones 8 and, opposite its four "cut-off corners," by four octagonal individual stones 6.

Corresponding to the contour of the octagonal individual stones 6 and the square individual stones 8 which are smaller in size, the covering element represented in FIG. 1 has zig-zag shaped edges 14. Apart from this zigzag shape, the covering element 2 shown is rectangular. At the longitudinal edges of the covering element 2, four octagonal individual stones 6 project slightly, while at the transverse edges two octagonal individual stones 6 project slightly. When a longitudinal edge contour of the covering element 2 is translated to the right, as far as the opposite longitudinal edge contour, these two contours substantially match. The same is true of the transverse edge contours. The same zigzag edge contour always recurs along one half the length of a longitudinal edge and one half the length of a transverse edge. Both in longitudinal direction and in transverse direction, therefore, neighboring covering elements 2 can readily be fitted together. Placement with staggering by half the length of a covering element or half the breadth of a covering element is also possible. The individual stones 4 may also be so arranged that the covering elements 2 can be laid in herring-bone pattern.

The individual stones 4 are preformed by rupture or weakening zones 16 which run zigzag from transverse edge to transverse edge and from longitudinal edge to longitudinal edge of the covering element 2 and, for the purpose of illustration, are indicated in the drawing by lines at two points. The weakening zones are formed by a succession of connecting portions or weakening zone sections constructed as bridges 12 and 18. At all four longer sides of the octagonal individual stones 6, a bridge to a neighboring square individual stone 8 is provided. The shorter oblique sides of the octagonal individual stones 6 are free of bridges. At the points at which in each case one octagonal individual stone 6 is joined together with a single neighboring square individual stone 8 to form a pair or a group 10, a bridge 12 of comparatively large cross-section is provided while, at the other connecting points to neighboring square individual stones 8, bridges 18 of smaller cross-section are provided (see FIGS. 2 and 3). The bridges 18, however, need not have the same cross-section everywhere in the covering element but may have a larger cross-section at points where higher stressing in manufacture, transport or handling is to be expected than at points where lower stressing is to be expected.

Typical dimensions of covering elements 2 embodying the invention are about 50 cm breadth and just under double this length. The number of individual stones 4 per covering element 2 lies typically approximately between 12 and 40. The weight of the covering element (apart from its size) depends on the thickness of the individual stones 4. Typical are weights between about 40 and 120 Kg. Covering elements 2 of this size can still be laid with a handcart without power assistance. In the case of still larger covering elements 2, recourse to power assistance is desirable.

When the square individual stones 8 are recessed with respect to the upper flat sides of the other covering elements 2, recessing of the upper sides of the square individual stones 8 by about 2 mm has proved satisfactory.

Figure 2:
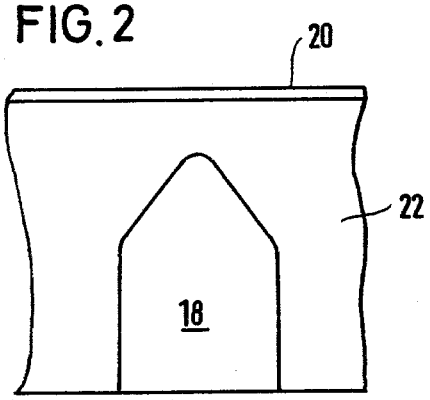
FIG. 2 is a bridge cross-section as seen along II—II in FIG. 1 of a bridge between individual stone groups.

The cross-section, shown in FIG. 2, of a bridge 18 consists of a square with superposed isosceles triangle, the corners at the transition from the square into the triangle and at the apex of the triangle being rounded off and the sides of the square being not strictly vertical but converging slightly upwardly. At points where lesser loading is to be expected, the bridge 18 may be constructed more narrowly so that its lower part becomes rectangular again with sides converging slightly upwardly.

The bridge 12 shown in FIG. 3 is in cross-section likewise built up from a lower rectangle with superposed isosceles triangle. However, the rectangle does not taper upwardly and extends laterally almost to the corners of the square individual stone 8 which is intended to be connected by the bridge 12 to a neighboring octagonal individual stone 6 to form a pair or a group 10. The cross-section rectangle of the bridge 12 occupies more than the half of the height of the individual stones 4. The apex, rounded off with large radius, of the isosceles cross-section triangle extends relatively close to the upper flat side 20 of the covering element 2; however, there still remains sufficient space to cover the bridge 12 from above with sand in the gap 22. The lateral transition between the cross-section triangle and the cross-section rectangle is also rounded off.

In FIGS. 2 and 3 it is also seen that the gaps, present above the bridges 12 and 18, between the individual stones 4 are chamfered at the transition into the upper flat side 20 of the covering element 2. Both beside the bridges 12 and beside the bridges 18 the gaps 22 between the neighboring individual stones 4 extend from the upper flat side 20 of the covering element 2 to the lower flat side.

Both the bridges 18 and, in particular, the bridges 12 could be made to extend almost or right up to the foot of the chamfer described above and also could be bounded in cross-section by an upper horizontal line. As gap 22 above the bridges there then remains only a notch of the depth of the chamfer. Since the bridge 12 according to FIG. 3 has not quite the breadth of the square individual stone 8, there results in plan view a wasp-waist-like constriction between the octagonal individual stone 6 and the square individual stone 8 of each group 10. It is also possible to make the bridges 12 exactly as wide as the square individual stones 8.

The bridges 12 and 18 end below flush with the lower flat side of the covering element 2.

As shown in FIG. 1, just in the longitudinal middle region of the covering element 2, the distribution of the bridges 12 of thicker cross-section is such that a transverse weakening zone 16 following the bridges 18 of weaker cross-section does not deviate from the rectilinear course merely by the size difference of the individual stones 4, but rather by the extent of the distance between two longer sides of an octagonal individual stone 6. This promotes stiffening of the covering element 2 precisely in this critical region.

The covering elements 2 embodying the invention serve preferably for the covering of roads, paths, yards, driveways, car parks, beds of water-courses and the like. They consist preferably of concrete. The bridges 12 and 18 and the gaps 22 can be formed in course of production of the covering element 2 by appropriate additions to shaping dies or by appropriate sheet-metal shapers between the individual stones 4.

In general, the individual stones 4 of varying size are so arranged relative to one another that the contour of the individual stones 4 of smaller size does not align on any side with the contour of the neighboring individual stones 4 of larger size. Preferred is a "surrounded" arrangement of the smaller-sized individual stones 4 relative to neighboring stones 4 of larger size, in particular a coincidence of any axes of symmetry of the two neighboring individual stones, of which the one is an individual stone 4 of larger size and the other is an individual stone 4 of smaller size. In general, the covering elements 2 embodying the invention have a multiplicity of individual stones 4. The bridges or weakening zone sections between the individual stones 4 should preferably give so great a cross-section weakening at the appropriate point of the covering element 2 that intended fracture zones are formed which do in fact break under correspondingly high load.

We claim:

1. A ground covering slab comprising first and second kinds of adjacent spaced, individual stones arranged in a pattern having first and second longitudinal edges, said first and second kinds of stones having first and second surface areas respectively; and first and second types of connecting elements located within the spaces between adjacent stones and interconnecting said stones to each other, the strength of said first type of connecting elements being greater than that of said second type of connecting elements, said connecting elements forming elongated rupture zones extending non-rectilinearly between said first and second longitudinal edges thereby stiffening said slab.

2. A ground covering slab as claimed in claim 1 wherein at least a portion of said connecting elements terminates below a plane that contains the top surface of said slab.

3. A ground covering slab as claimed in claim 2 wherein all of said connecting elements terminate below said plane.

4. A ground covering slab as claimed in claim 1 wherein each of said stones is connected to each neighboring stone by a single one of said connecting elements.

5. A ground covering slab as claimed in claim 1 wherein first and second pluralities of said stones are joined to form first and second groups of stones, respectively, the connecting elements between the stones of each group being of said first type and the connecting elements between said first and second groups of stones being of said second type.

6. A ground covering slab as claimed in claim 5 wherein each of said first and second groups of stones comprises a stone of said first kind and a stone of said second kind.

7. A ground covering slab as claimed in claim 5 wherein each of said first type of connecting elements has a cross-sectional area which is more than half the areas of the sides of the stones being connected thereby.

8. A ground covering slab as claimed in claim 1 wherein said first and second kinds of stones have surface areas which are octagonal and square in shape, respectively.

9. A ground covering slab as claimed in claim 1 wherein each of said stones is connected to one adjacent stone by a connecting element of said first type, said stone being connected to all other adjacent stones by connecting elements of said second type.

10. A ground covering slab as claimed in claim 1 wherein each stone of said first kind is connected only to stones of said second kind.

11. A ground covering slab as claimed in claim 1 wherein a plurality of said connecting elements are spaced apart and form a row and said row forms a rupture zones.

12. A ground covering slab as claimed in claim 1 wherein said first and second types of connecting elements are of at least two different dimensions respectively.

13. A ground covering slab according to claim 1 which includes stones that have corners as seen in plan view and gaps at said corners which extend from the top surface of said slab to its underside.

* * * * *